US006658312B1

(12) United States Patent
Hagiyama

(10) Patent No.: US 6,658,312 B1
(45) Date of Patent: Dec. 2, 2003

(54) WIRE HARNESS MANUFACTURING APPARATUS AND METHOD

(75) Inventor: Katsumi Hagiyama, Sizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/701,371

(22) PCT Filed: May 27, 1999

(86) PCT No.: PCT/JP99/02797

§ 371 (c)(1),
(2), (4) Date: Nov. 29, 2000

(87) PCT Pub. No.: WO99/63551

PCT Pub. Date: Dec. 9, 1999

(30) Foreign Application Priority Data

May 29, 1998 (JP) ..... 10/149919

(51) Int. Cl.[7] ..... H01B 13/00; H01R 43/28

(52) U.S. Cl. ..... 700/95; 700/95; 700/116; 700/213; 29/33 F; 29/561

(58) Field of Search ..... 700/1–5, 7, 9, 700/11, 12, 14, 15, 17, 19–21, 23–25, 28, 29, 32, 48, 49, 53, 54, 83, 84, 89, 95–97, 99–105, 108, 117, 169, 173, 174, 184, 221–226, 249; 361/826

(56) References Cited

U.S. PATENT DOCUMENTS 4,653,159 A * 3/1987 Henderson et al. ..... 29/33 M
5,012,391 A * 4/1991 Schultz, Jr. et al. ..... 361/428
5,483,459 A * 1/1996 Tamura ..... 364/469
5,610,454 A * 3/1997 Nishikawa et al. ..... 307/147
5,687,477 A * 11/1997 Soriano ..... 29/872
5,777,876 A * 7/1998 Beauchesne ..... 364/468.01
5,844,783 A * 12/1998 Kojima ..... 361/777
5,980,086 A * 11/1999 Kanematsu et al. ... 364/468.07
6,092,001 A * 7/2000 Mizuno et al. ..... 700/116
6,169,934 B1 * 1/2001 Nakayama et al. ..... 700/213
6,249,715 B1 * 6/2001 Yuri et al. ..... 700/111

FOREIGN PATENT DOCUMENTS

JP 6-5132 1/1994
JP 408222046 A * 8/1996 ..... H01B/13/00

* cited by examiner

*Primary Examiner*—Albert W. Paladini
*Assistant Examiner*—Sean Shechtman
(74) *Attorney, Agent, or Firm*—Oblon, Spivak, McClelland, Maier & Neustadt, P.C.

(57) ABSTRACT

A wire harness manufacturing apparatus includes plural manufacturing lines for respectively manufacturing plural sub-wire harnesses as constituents of a wire harness to be produced, each of the manufacturing lines including plural constituent devices arranged in manufacturing order of each sub-wire harness. Plural line control devices are provided for controlling operational processes of the manufacturing lines respectively. Each of the line control devices is connected with the constituent devices of each of the manufacturing lines through a signal transmitting circuit. At least one system control device is adapted so as to construct a signal transmitting network together with the line control devices, for controlling manufacturing loads among the plural manufacturing lines.

1 Claim, 6 Drawing Sheets

WIRE HARNESS MANUFACTURING APPARATUS AND METHOD

TECHNICAL FIELD

The present invention relates to a wire harness manufacturing apparatus for and method of automatically manufacturing a wire harness to be installed in an automotive vehicle, especially, sub-wire harnesses as constituents of the wire harness and a method of controlling a period of "tact time" in the wire harness manufacturing apparatus, too.

BACKGROUND ART

In Japanese Unexamined Patent Publication (kokai) No. 6-5132, there is disclosed an earlier art wire harness manufacturing apparatus where a wiring plate is transferred from one device as a module to the other device in order, while a wire harness is continuously assembled on the moving wiring plate.

Then, each modular device is constituted by a base, a processing mechanism mounted on the base and a transporting unit attached to the base.

Note, in the adjoining modular devices, the base of one modular device is adapted so as to be connectable with the base of the adjoining modular device.

Further, the transporting unit is provided with a portion for transporting the wiring plate in the base and a projecting portion. When it is required to connect the base of one modular device with the base of the adjoining modular, the projecting portion of the transporting unit is inserted into the base of the other device In this way, as the conventional wire harness manufacturing apparatus has the plural modular devices provided for processes respectively and connected with each other, it is possible to increase or decrease the number of modular devices, corresponding to the constitution of the wire harness to be manufactured. Further, by arranging the modular devices of designated number in order, it is also possible to adjust the production capability in an optional process so as to cope with the wire harness being manufactured, thereby also corresponding to the change of design of the wire harness.

In the conventional wire harness manufacturing apparatus, however, since the plural devices as modules for processes are controlled independently of each other, it is difficult to balance the manufacturing loads among the constituent devices appropriately and therefore, there is a problem of occurrence of intermediate stocks among the processes.

Additionally, if the wire harness is subjected to the change of design or manufactured by another manufacturing line, it is necessary to not only alter the control data every devices but rearrange the constituent devices of the manufacturing line with an operator's burden. In conclusion, the conventional wire harness manufacturing apparatus has a problem of wasting time in order to establish a new manufacturing line.

Disclosure of Invention

Under such a circumstance, it is therefore an object of the present invention to provide a wire harness manufacturing apparatus and a tact time controlling method thereof, both of which are capable of reducing the occurrence of intermediate stocks to the utmost and also facilitating a measure against the change of design of the wire harness or the change in manufacturing line itself, whereby it is possible to establish the manufacturing line in a remarkable short time if such a change is raised.

The object of the present invention described above can be accomplished by a wire harness manufacturing apparatus comprising:

plural manufacturing lines for respectively manufacturing plural sub-wire harnesses as constituents of a wire harness to be produced, each of the manufacturing lines consisting of plural constituent devices arranged in manufacturing order of each sub-wire harness;

plural line control devices provided for controlling operational processes of the manufacturing lines respectively, each of the line control devices being connected with the constituent devices of each of the manufacturing lines through a signal transmitting circuit; and at least one system control device adapted so as to construct a signal transmitting network together with the line control devices, for controlling manufacturing loads among the plural manufacturing lines.

With the above-mentioned constitution, the wire harness is manufactured by plural manufacturing lines manufacturing sub-wire harnesses as the constituents of wire harness.

In operation, the plural manufacturing lines are controlled by the corresponding line control devices, while manufacturing loads among the manufacturing lines are balanced by the single system control device. Consequently, it is possible to operate the plural manufacturing lines while reducing so-called "intermediate" stocks existing among the respective manufacturing lines to the utmost.

While, manufacturing loads among the constituent devices in each manufacturing line are balanced by the line control device, whereby it is possible to operate the devices while reducing the intermediate stocks existing among the respective devices to the utmost.

In the present invention, preferably, each of the line control devices comprises:

a variable data recording unit for recording variable data in the constituent devices and the variable data altered later;

a line central processing unit for judging whether constitution of the constituent devices in the manufacturing line is appropriate by comparing production reserving data inputted from the system control device with the variable data, the line central processing unit further judging whether the manufacturing line modified on the basis of the former judgment is appropriate or not;

a line display unit for displaying both variable data recorded on the variable data recording unit and result of judgment obtained by the line central processing unit;

a line input unit for inputting an operation starting signal and the altered variable data obtained by modifying the manufacturing line in accordance with a result of judgment by the line central processing unit; and a production command unit for inputting the production reservation data generated from the line central processing unit as a result of the line input unit's inputting the operation start signal, the production command unit sequentially outputting the production command signal based on the production reservation data to each of the constituent devices; and wherein the system control device comprises:

a data base for the wire harness to be produced;

a common data recording unit for recording common data in common with the plural manufacturing lines and the sequent common data added later;

a system input unit for inputting product data of the wire harness and the added common data;

a system central processing unit for making out an article numbers' list of the sub-harnesses constituting the wire harness by comparing the product data with the data recorded in the data base;

comparing the data of the sub-wire harnesses of respective article numbers with the above common data and the variable data in the respective data recording units in the line control devices in order to determine the manufacturing line in charge of each sub-wire harness with the article number; and making out the production reservation data for each manufacturing line determined, on the basis of the product data;

a system display unit for displaying the product data, the common data, the variable data, the article numbers' list, the determined manufacturing lines in charge and the production reservation data; and a reservation data transmitting unit for transmitting the production reservation data to the line central processing unit of the line control device of the manufacturing line being determined.

In the above-mentioned apparatus, when inputting the product data of the wire harness being produced through the system input unit, then the article numbers' list of the sub-wire harnesses constituting the wire harness is formed by the system control device. Additionally, by the system control device, the manufacturing line in charge of the sub-wire harness of each article number is determined and the production reservation data is formed for every manufacturing line. Since the production reservation data is being formed while balancing the manufacturing loads among the manufacturing likes, it is possible to reduce the intermediate stocks existing among the respective manufacturing lines to the utmost. The production reservation data is outputted from the system control device and inputted to the line control device of each manufacturing line.

Further, when the rearrangement of the constitution is executed, the variable data due to the rearrangement is inputted into the line input unit and registered in the variable data recording unit.

In each of the manufacturing lines, preferably, the line control device includes a tact time recording unit for recording tact time of the corresponding manufacturing line being inputted by the line input unit; the line central processing unit is constituted with one function to calculate waiting time being inputted through the system control device and the tact time thereby to determine cycle time of the corresponding manufacturing line and another function to transmit the cycle time to the production command unit upon inputting an operation starting signal; and the production command unit is constituted with a function to output signals so that the corresponding manufacturing line works in accordance with the cycle time; and preferably, the system central processing unit is constituted with one function to comparatively calculate respective tact time registered in the tact time recording units of the plural line control devices thereby to determine respective waiting time of the plural manufacturing lines and another function to transmit the respective waiting time to the reservation data transmitting unit; and the reservation data transmitting unit is constituted with a function to transmit each waiting time to the line central processing unit of the corresponding line control device.

In the above-mentioned arrangement, since the respective manufacturing lines are adapted so as to operate in accordance with the cycle time calculated by the waiting time and the tact time, it is possible to reduce the intermediate stocks existing among the respective manufacturing lines to the utmost.

According to the invention, there is also provided a method of controlling tact time of the wire harness manufacturing apparatus mentioned above, the method comprising the steps of:

measuring the tact time for each of the manufacturing lines by preliminarily operating the manufacturing line in advance of its practical operation;

allowing the line control device of the manufacturing line to input the tact time for registration;

calculating the waiting time for the manufacturing line by the system control device, on the basis of the tact time recorded in the line control device;

transmitting the calculated waiting time to the line control device of the manufacturing line; and both calculating the cycle time of the manufacturing line in charge and controlling the operation of the manufacturing line in accordance with the calculated cycle time, by the line control device.

According to the method, since the tact time is measured by operating the manufacturing line actually and thereafter, the waiting time and the cycle time are obtained on the basis of the tact time, it is possible to obtain the cycle time with high accuracy. Therefore, the manufacturing lines are controlled so as to reduce the intermediate stocks among the manufacturing lines due to the manufacturing loads to the utmost, by the respective cycle time with high accuracy.

In the above-mentioned method, it is more preferable that the line control device automatically measures the tact time of the practical operation after finishing the operation of the corresponding manufacturing line at constant cycles and replaces the registered tact time with the tact time of the practical operation for registration; the system control device calculates new waiting time for each of the manufacturing lines on the basis of the tact time of the practical operation registered in the line control device and transmit the new waiting time to the line control device of the manufacturing line; and that the line control device calculates new cycle time of the manufacturing line and controls the operation of the manufacturing line in accordance with the new cycle time.

In this case, since the tact time, the waiting time and the cycle time are reviewed for corrections after the actual operation of the constant number of cycles, it is possible to manage the respective cycle time of the manufacturing lines with high accuracy.

According to the invention, there is also provided a wire harness manufacturing method, comprising the steps of:

inputting product data of the wire harness to be manufactured with a system input unit;

reading out record data from a data base to a system central processing unit when inputting the product data, and making an article number's list of sub-wire harnesses constituting the wire harness to be manufactured by comparing the record data with the product data;

reading out common data from a common data recording unit to the system central processing unit and variable data from variable data recording units of line control devices, and determining at the system central processing unit which of the manufacturing lines takes charge of manufacturing the sub-wire harness of each article number by comparing both the common data and variable data with the data of the sub-wire harness of each article number in the article number's list;

making at the system central processing unit, production reservation data for each manufacturing line determined in the above way, on the basis of the product data;

transmitting the production reservation data for each of the manufacturing lines from the system central processing unit through a reservation data transmitting unit to a line central processing unit of a corresponding line control device;

reading out variable data from the variable data recording unit to the line central processing unit, comparing the variable data with the production reservation data at the line central processing unit to judge whether or not a constitution of constituent devices in an existing manufacturing line is appropriate, and changing the constitution of devices of the present manufacturing line on the basis of a result of a judgment of the line central processing unit;

transmitting the production reservation data from the line central processing unit to a production command unit on receipt of the operation starting signal from a line input unit, and transmitting a production command signal based on the production reservation data from the production command unit to each of the constituent devices; and activating the respective constituent devices in the manufacturing line to manufacturing a corresponding sub-wire harnesses in accordance with the production reservation data.

In the above-mentioned method, since the production reservation data is being formed while balancing the manufacturing loads among the manufacturing lines, it is possible to reduce the intermediate stocks existing among the respective manufacturing lines to the utmost.

These and other objects and features of the present invention will become more fully apparent from the following description and appended claims taken in conjunction with the accompany drawing.

BEST MODE FOR CARRYING OUT THE INVENTION

Embodiments of the present invention will be described with reference to the accompanying drawings.

Figure 1:
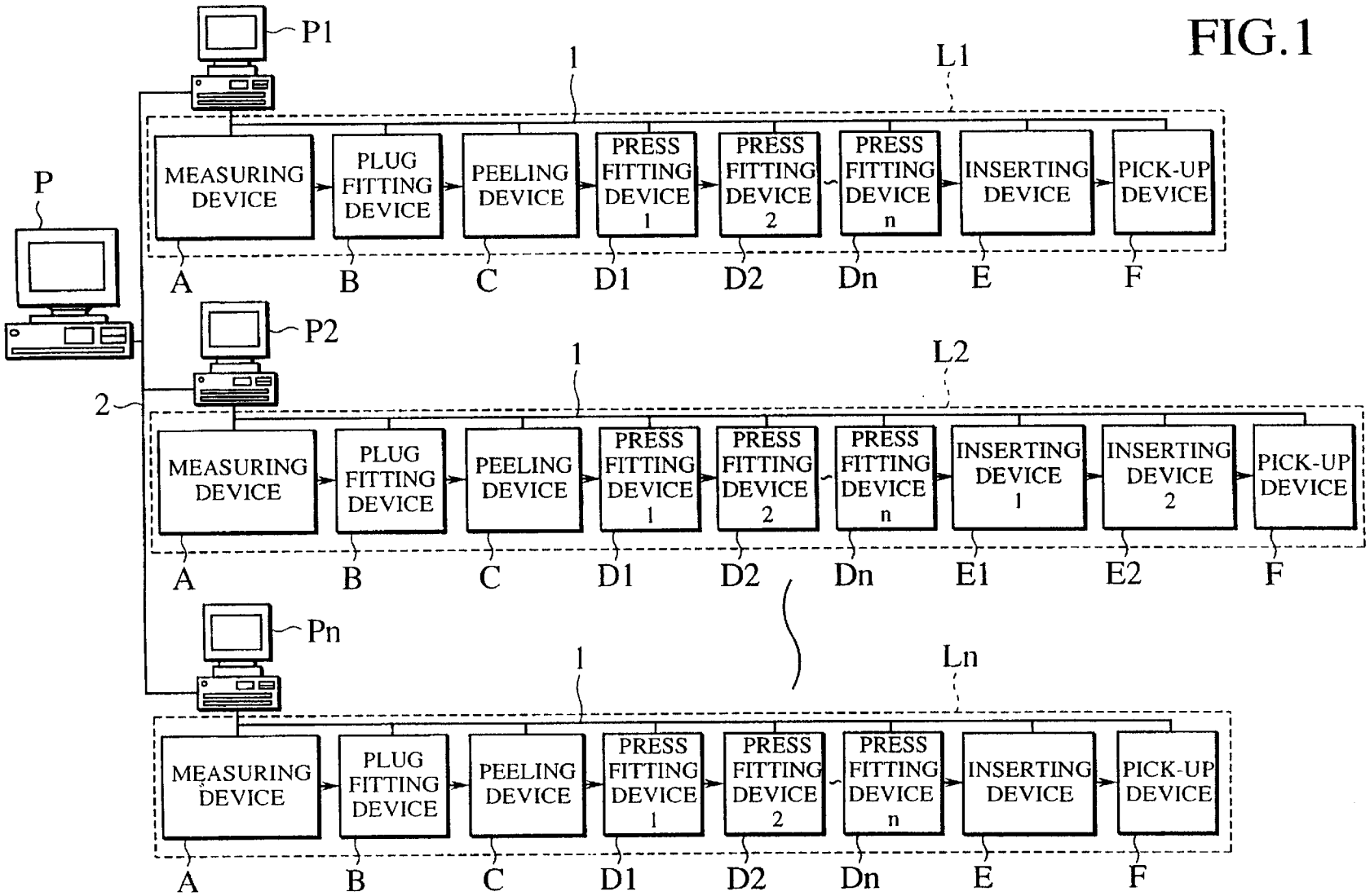
FIG. 1 is a systematic diagram of a wire harness manufacturing apparatus in accordance with an embodiment of the present invention, showing the constitution.

FIG. 1 shows a systematic constitution of a wire harness manufacturing apparatus in accordance with one embodiment of the invention. The wire harness manufacturing apparatus comprises plural manufacturing lines L1, L2, . . . , Ln for manufacturing plural sub-wire harnesses constituting the wire harness, plural line control devices P1, P2, . . . , Pn each connected with constituent devices A, B, . . . , F of each manufacturing line L1 (L2, . . . , Ln) through a signal line 1, for controlling the working process of the manufacturing line and at least one system control device P constructing the line control devices P1, P2, . . . , Pn and a signal network 2 for controlling manufacturing loads among the plural manufacturing lines L1, L2, . . . , Ln.

Each of the manufacturing lines L1, L2, . . . , Ln is constituted by a variety of devices required in order to manufacture the wire harness to be produced. Normally, each of the manufacturing lines L1, L2, . . . , Ln is composed of the built-in devices characterized by the constitution of the wire harness, between a measuring device A for measuring the length of a wire and sequentially cutting it and a pick-up device F for forwarding the completed sub-harness to the next process in order to manufacture the required harness by bundling the completed sub-harness with other sub-harnesses.

For example, in case of the wire harness having a waterproof housing, then a plug device B for penetrating a rubber plug through the wire is built ahead of a peeling device C for exposing core lines of the wire (e.g. the manufacturing lines L1, L2, . . . , Ln). While, in case of the wire harness having various terminals or various wires in different diameters, there may be provided a plurality of press-fitting devices D1, D2, . . . , Dn for fitting the terminal to the core lines on pressure, in accordance with each processing capability (e.g. the manufacturing lines L1, L2, . . . , Ln). Further, in case of the wire harness having various housings, there may be provided a plurality of inserting devices E1, E2 for inserting the terminals into the housings, in accordance with each processing capability (e.g. the manufacturing line L2). Or again, in case of the wire harness having at least one branch part extending from a trunk, one or more branching devices (not shown in the figure) may be built in the manufacturing line, for bending the wire simply or forming the branch part by means of a joint terminal.

Furthermore, the manufacturing line may be equipped with an indispensable inspecting device (not shown). For example, there is a case that a peeling inspecting device (also not shown) is arranged between the peeling device C and the press-fitting device D1, for inspecting whether a proper peeling has been carried out in the preceding peeling device C.

Figure 2:
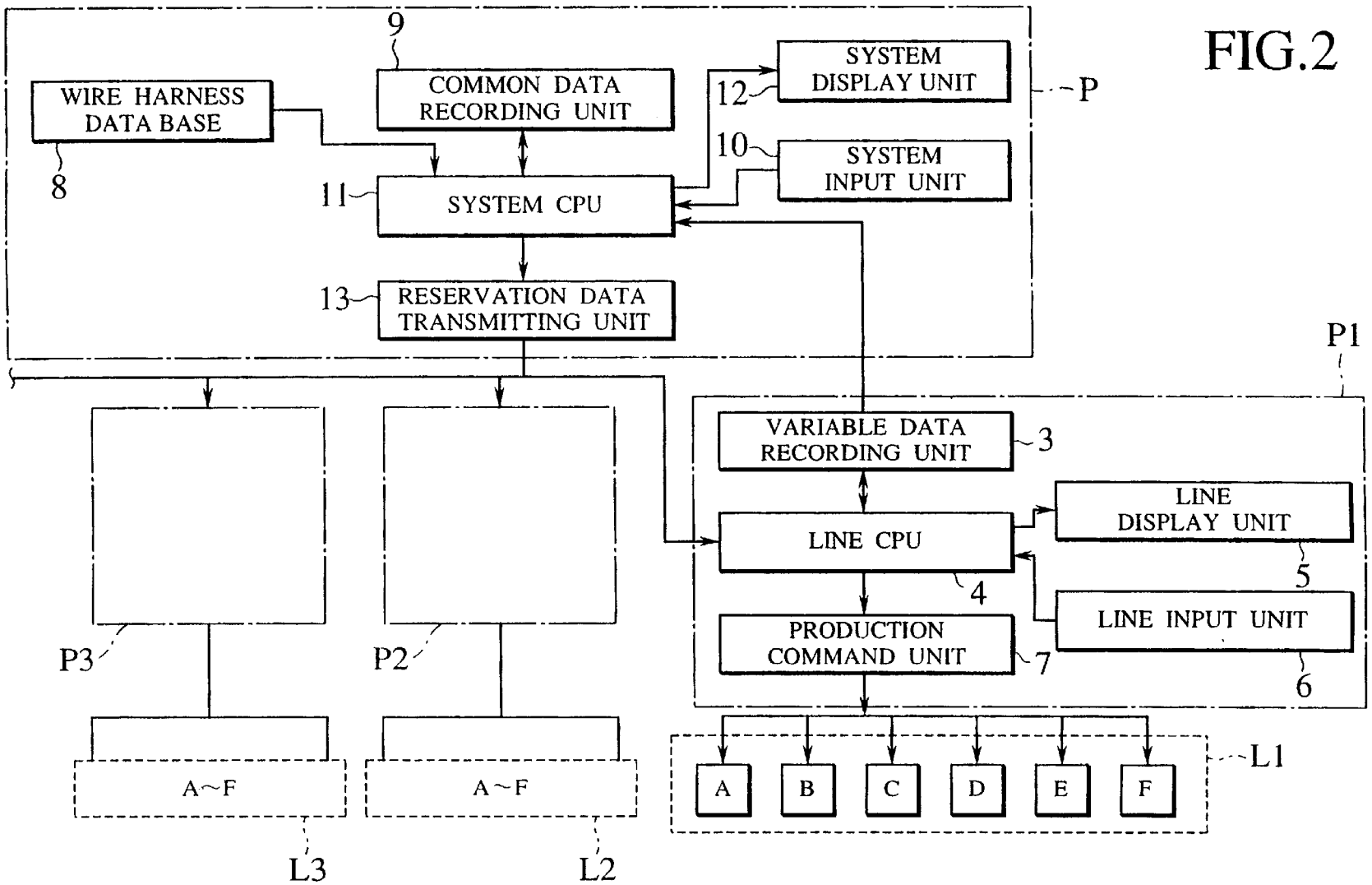
FIG. 2 is a block diagram showing a control system of the wire harness manufacturing apparatus of FIG. 1.

The line control devices P1, P2, . . . , Pn and the system control device P are constituted by respective personal computers each having such functions as shown in FIG. 2. Since each of the line control devices P1, P2, . . . , Pn is constituted with the same functions, we now describe those of the line control device P1 in behalf of the devices P1, P2, . . . , Pn.

That is, the line control device P1 includes a variable data recording unit 3, a line central processing unit (CPU) 4, a line display unit 5, a line input unit 6 and a production command unit 7. In the device P1, the variable data recording unit 3 records variable data in the constituent devices A, B, . . . , F and the variable data altered later. The line CPU 4 judges whether the constitution of the devices A to F in the manufacturing line L1 is appropriate by comparing production reserving data inputted from the system control device P with the variable data. The line CPU 4 further judges whether the manufacturing line modified on the basis of the above judgment is appropriate or not. The line display unit 5 displays both variable data recorded on the variable data recording unit 3 and result of judgment obtained by the line CPU 4. The line input unit 6 inputs an operation starting signal and the altered variable data obtained by modifying the manufacturing line L1 in accordance with the result of judgment by the line CPU 4. Inputting the above production reservation data generated from the line CPU 4 inputting the operation start signal, the production command unit 7 outputs the production command signal based on the production reservation data to each of the constituent devices A, B, . . . , F.

The system control device P comprises a harness data base 8, a common data recording unit 9, a system input unit 10, a system central processing unit (CPU) 11, a system display unit 12 and a reservation data transmitting unit 13. In the control device P, the common data recording unit 9 registers the common data in common with plural manufacturing lines L1, L2, . . . , Ln and the sequent common data added later. The system input unit 10 inputs product data of the wire harness to be manufactured and the added common data. The system CPU 11 makes an article numbers' list of the sub-harnesses constituting the wire harness to be manufactured by comparing the product data with the data registered in the data base 8. The CPU 11 also compares the data of the sub-wire harnesses of respective article numbers with the above common data and the variable data in the respective data recording units 3 in the line control devices P1, P2, . . . , Pn in order to determine the manufacturing line L1, L2, . . . , or Ln in charge of each sub-wire harness with the article number. Further, on the basis of the product data, the CPU 11 makes out the production reservation data for each manufacturing line L1, L2, . . . , or Ln determined as above. The system display unit 12 displays the product data, the common data, the variable data, the article numbers' list, the determined manufacturing lines in charge and the production reservation data. The reservation data transmitting unit 13 transmits the production reservation data to the line CPU 4 of the line control device P1, P2, . . . or Pn of the manufacturing line L1, L2, . . . , or Ln being determined.

Hereto, the line display unit 5 and the system display unit 12 are constituted by respective display units of the personal computers, while the line input unit 6 and the system input unit 10 are constituted by respective keyboards of the personal computers.

The variable data registered in the variable date recording unit 3 contains the sorts of constituent devices of the corresponding manufacturing line, the numbers of devices, the order of arrangement, the mechanical parameters of devices and so on.

For example, in the manufacturing line L1 having one measuring device A, one plug device B, one peeling device C, plural (n) press-fitting devices S1, D2, . . . , Dn, one inserting device E and one pick-up device F arranged in accordance with the process order, the sorts of these devices, the numbers of devices and the order of arrangement are recorded as the variable data.

As to the mechanical parameters as the variable data, in case of the measuring device A, they may be constituted by the position for exchanging a nozzle allowing the wire through, the "stand-by" position of a chuck spindle for holding the wire at cutting, the addresses of nozzles in each cartridge where plural (e.g. 12 pieces) nozzles are assembled on a nozzle base, the color, size, etc. of each wire contained in the cartridge and so on. Alternatively, they may be constituted by the article number of a rubber plug, the stand-by position of an inserting spindle, the stand-by position of a "supply" spindle, etc. in case of the plug device B. Or again, in case of the press-fitting device D1, D2, . . . , or Dn, the article number of a terminal on use, the address of press-fitting, the height of press-fitting, etc. may be regarded as the mechanical parameters. Similarly, the article number of a housing, an address of insertion, a span of insertion, etc. may be regarded in the inserting device E, while the "stand-by" and acceptance positions etc. may be regarded as the mechanical parameters in the pick-up device F.

Incidentally, regarding the aforementioned variable data altered later, it should be noted that if the corresponding manufacturing line has not sufficient processing capability due to the difference in constitution of the sub-wire harness being manufactured and/or the change in production output, then the line CPU 4 judges that such a manufacturing line is not proper to produce the sub-wire harness, so that there will be raised a necessity to alter the constitution of devices in the manufacturing line for attaining the required processing capability. The later-altered variable data is represented by the sorts, numbers and order of the devices which will be added or deleted in order to cope with the above necessity and also the mechanical parameters of the devices, etc. For example, when the number of terminals (or housings) in the sub-wire harness being manufactured changes, the number of the press-fitting devices and/or the inserting devices is accordingly changed to adjust the processing capability of the corresponding manufacturing line.

In the data base 8, there are registered the constitution of the different sub-wire harnesses which are accompanied with respective article numbers. Then, the constitution of the sub-wire harness is represented by the kind, size and length of wires, the article number of a rubber plug, the same of terminals, the address of terminals, the article number of housing, the address of housing and so on. Additionally, if the wire harness to be manufacture has to include a new sub-wire harness which has not registered in the data base 8 yet, it is carried out to input the article number and constitution of the above sub-wire harness through the system input unit 10.

The common data recorded on the common data recording unit 9 consists of the wire's size for every sorts of the wires, an amount of chucking, the address for chucking, the sort of wire suitable for each article number of the rubber plug, an amount of insertion, a length of plug's return, a peeling depth for every sorts of wires, a length of wire's return at peeling, the wire's size for every article numbers of the terminals, a depth of press-fitting, etc.

Additionally, in case of using a new material (e.g. a new type of wire, rubber plug or terminal), the subsequently-added common data are similar to the previously-mentioned common data about the new material.

The product data of the wire harness being manufactured is expressed by the kind, size and length of wires, the article number of a rubber plug, the same of terminals, the address of terminals, the article number of housing, the address of housing, etc. in view of exhibiting the constitution.

Figure 4:
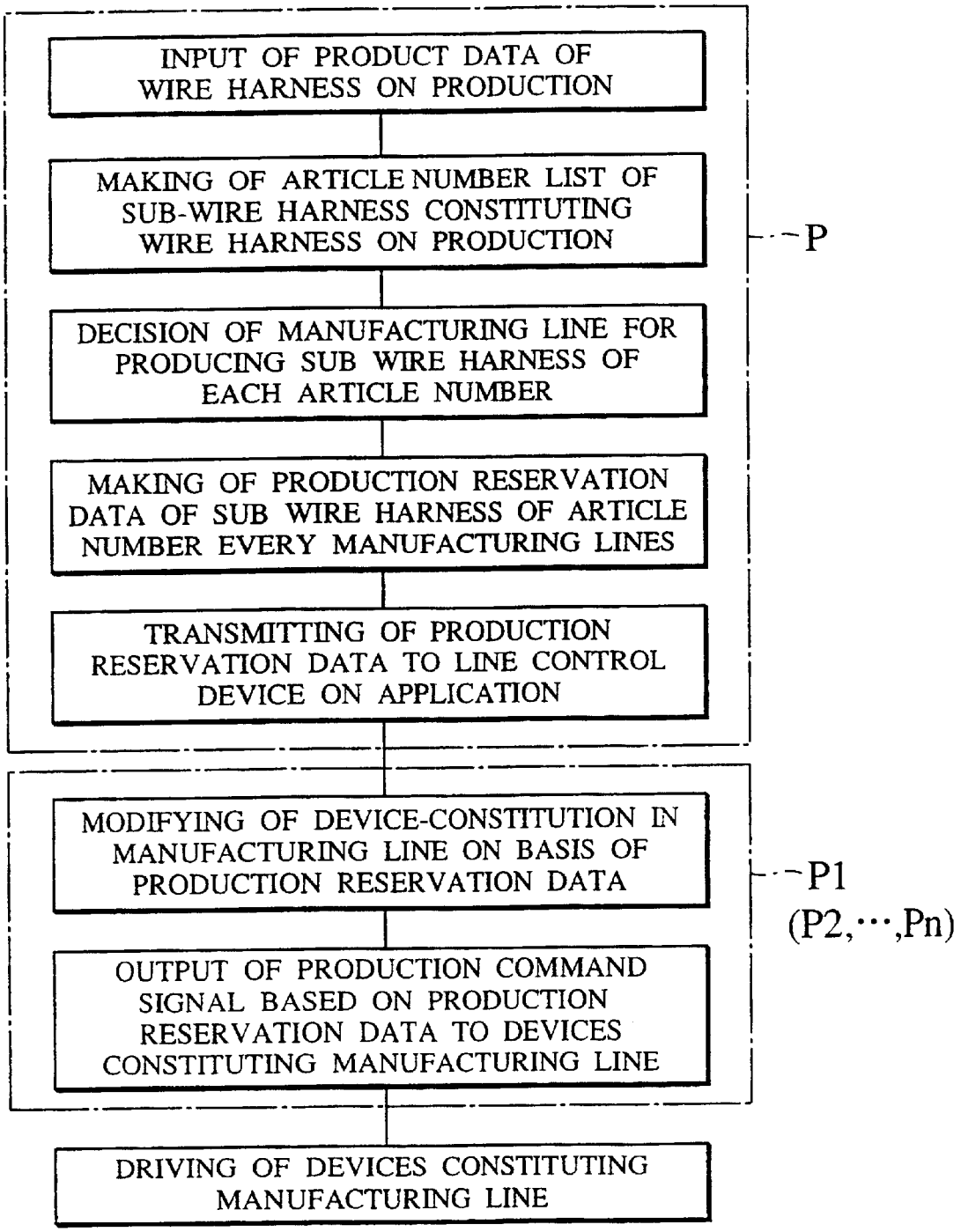
FIG. 4 is a flow chart of processes executed by the control system of FIG. 2.

The so-constructed wire harness manufacturing apparatus operates in accordance with a flow chart of FIG. 4.

First of all, the product data of the wire harness being manufacture are inputted by the system input unit 10.

Inputting the product data, the system CPU 11 carries out the readout of the recording data in the data base 8 and makes the article number's list of the sub-wire harnesses constituting the wire harness being manufactured by comparing the recording data with the above product data. Both article number's list and product data can be displayed on the system display unit 12, while the wire harness made from the sub-wire harnesses on the list can be simulated by the system display device for confirmation.

Next, upon the readout of the common data in the common data recording unit 9 and the variable data in the variable data recording units 3, 3, . . . , 3 of the line control devices P1, P2, . . . , Pn, the system CPU 11 determines which of the manufacturing lines L1, L2, . . . , and Ln takes charge of manufacturing the sub-wire harness of each article number by comparing both data with the data of the sub-wire harness of each article number in the article number's list. The common data in the common recording unit 9, the variable data in the variable data recording units 3 and the determination of the manufacturing line in charge can be displayed on the system display unit 12.

Further, the system CPU 11 makes the production reservation for each manufacturing line L1, L2, . . . , or Ln determined in the above way, on the basis of the product data. This production reservation data can be displayed on the system display unit 12.

This production reservation data for each of the manufacturing lines is outputted from the reservation data transmitting unit 13 to the line CPU of the corresponding line control device P1. For example, the production reservation data of the manufacturing line L1 is outputted to the line CPU 4 of the line control device P1.

The line CPU 4 takes in the recording data in the variable data recording unit 3 and compares the recording data with the production reservation data thereby to judge whether or not the constitution of constituent devices A to F in the existing manufacturing line L1 is appropriate. For example, in the measuring device A, it is judged by the production reservation data whether or not the size and color of wire on each nozzle address are identical to those of the sub-wire harness being manufactured. Or, in the press-fitting devices D1, D2, . . . , and Dn, it is judged by the production reservation data whether appropriate kind and number of terminals are selected corresponding to both number and address of terminals of the sub-wire harness being manufactured.

When it is judged that the manufacturing line is proper, the present manufacturing line can maintain the constitution of devices. On the contrary, if not, there is produced a need to change the constitution of devices of the present manufacturing line. In such a case, the constitution of device in the line will be modified by rearranging the constituent devices manually. The variable data recorded in the variable data recording unit 3 and the judgment can be displayed on the line display unit 5. When carrying out the rearrangement of the devices, the new variable data resulting from the arrangement is inputted as the "later-altered" variable data through the line input unit 6 and thereafter, recorded in the variable data recording unit 3.

Next, after confirming that the manufacturing line is proper by the above judgment, the line CPU 4 sends the production reservation data to the production command unit 7 on receipt of the operation starting signal from the line input unit 6. Note, in the modification, the operation starting signal may be generated by manipulating a "push button" type of switch (not shown) disposed outside the personal computer constituting the line control device.

Inputting the production reservation data, the production command unit 7 further transmits each of the constituent devices A to F the production command signal based on the production reservation data.

Consequently, the respective device A to F in the line L1 are activated to manufacture the corresponding sub-wire harnesses in accordance with the production reservation data.

Thus, according to the embodiment, by comparing the variable data registered in the variable data recording units 3, 3, . . . , 3 in the plural line control devices P1, P2, . . . , Pn with each other, the production reservation data is formed in a manner that the manufacturing loads are well-balanced among the manufacturing lines L, L2, . . . , and Ln. Consequently, it is possible to reduce goods in stock among the respective manufacturing lines L1, L2, . . . , Ln to the utmost.

Additionally, according to the embodiment, since the manufacturing line can be easily rearranged into the constitution of appropriate devices on the basis of the judgment on the line control device, it is possible to establish the manufacturing line in a short time to the utmost and also construct the constitution of devices so as to reduce the intermediate stock among the constituent devices to the utmost.

Figure 3:
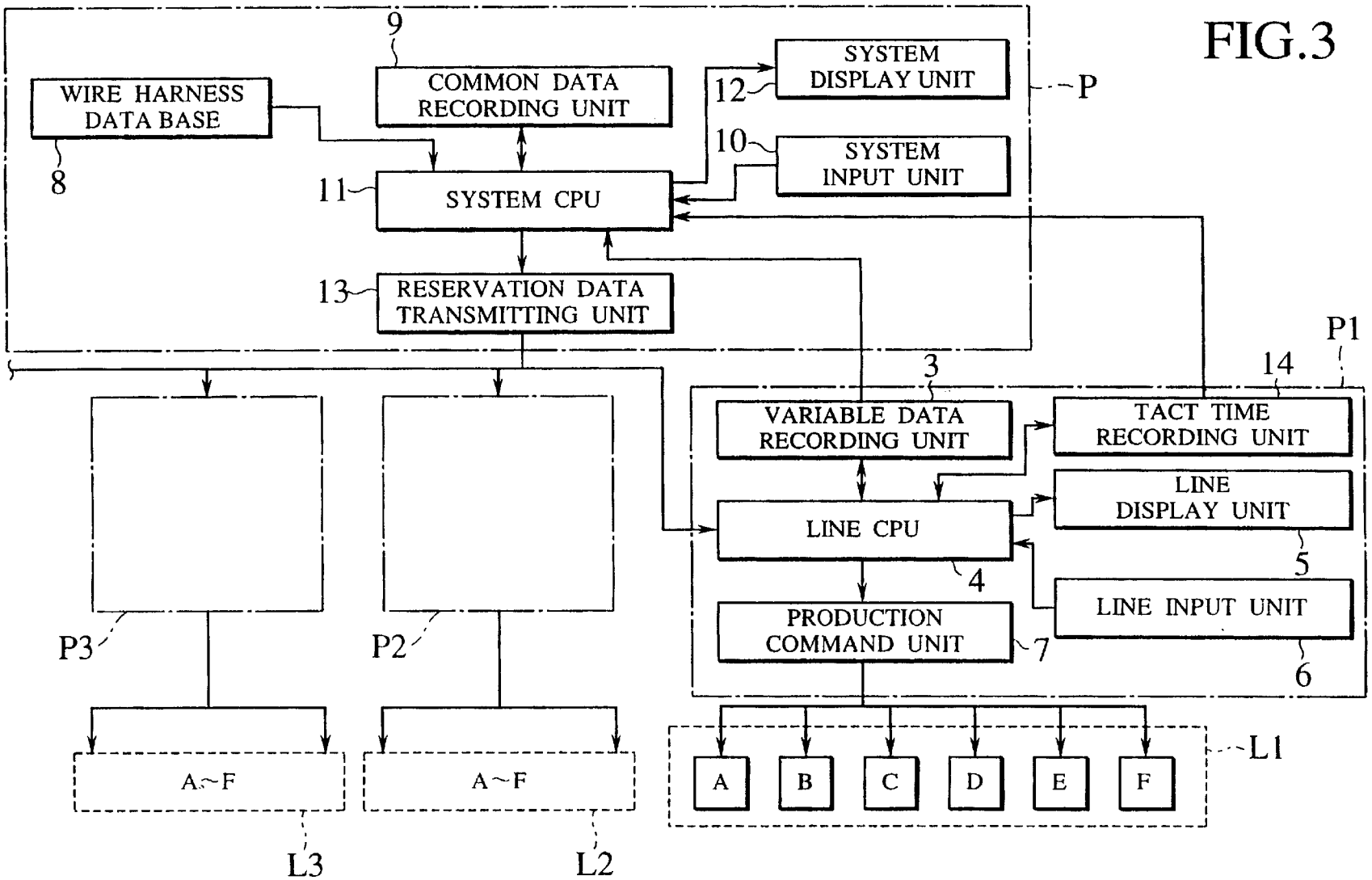
FIG. 3 is a block diagram showing another control system of the wire harness manufacturing apparatus of FIG. 1.

FIG. 3 shows another control system of the wire harness manufacturing apparatus. The control system is constituted so that the line control device has a tact time recording unit for recording the tact time. The remaining constitution of the embodiment is similar to that of the previously-mentioned embodiment.

That is, each line control device P1 includes a tact time recording unit 14 for recording tact time of the corresponding manufacturing line being inputted by the line input unit 6, while the line CPU 4 is constituted with one function to calculate both waiting time being inputted through the system control device P and tact time thereby to determine cycle time of the corresponding manufacturing line and another function to transmit the cycle time to the production command unit 7 upon inputting an operation starting signal and the production command unit 7 is constituted with a function to output signals so that the corresponding manufacturing line works in accordance with the cycle time. The system CPU 11 is constituted with one function to comparatively calculate respective tact time registered in the tact time recording units 14 of the plural line control devices P1, P1, . . . , Pn thereby to determine respective waiting time of the plural manufacturing lines and another function to transmit the respective waiting time to the reservation data transmitting unit 13, while the reservation data transmitting unit 13 is constituted with a function to transmit each waiting time to the line CPU 4 of the corresponding line control device.

Hereto, on the basis of the manufacturing line having the maximum tact time in the respective manufacturing lines, the waiting time is defined as a difference between the maximum tact time and the tact time of the other manufacturing line. The cycle time is equal to the total time from the beginning of one manufacturing cycle up to the sequent beginning of the next manufacturing cycle, including the waiting time.

Therefore, since the respective manufacturing lines L1, L2, . . . , Ln are adapted so as to operate in accordance with the cycle time obtained by the calculation of the waiting time and the tact time, it is possible to reduce the intermediate stock staying among the manufacturing lines as a result of the manufacturing loads of the respective manufacturing lines, as possible.

According to the embodiment, a method of controlling the tact time is executed as follows.

That is, the tact time for each manufacturing line L1 (L2, . . . , Ln) is measured by preliminarily operating each manufacturing line L1 (L2, . . . , Ln) in advance of the practical operation. Then, the so-obtained tact time is inputted to the line control device P1 (P2, . . . , Pn) of the manufacturing line L1 (L2, . . . , Ln) for registration. Then, the system control device P calculates the waiting time for each manufacturing line L1 (L2, . . . , Ln) on the basis of the tact time recorded in the line control device P1 (P2, . . . , Pn) and transmits the calculated waiting time to the line control device P1 (P2, . . . , Pn) of the manufacturing line L1 (L2, . . . , Ln). In the line control device P1 (P2, . . . , Pn), it is executed to calculate the cycle time of the manufacturing line in charge and control the operation of the manufacturing line in accordance with the so-calculated cycle time.

Figure 5:
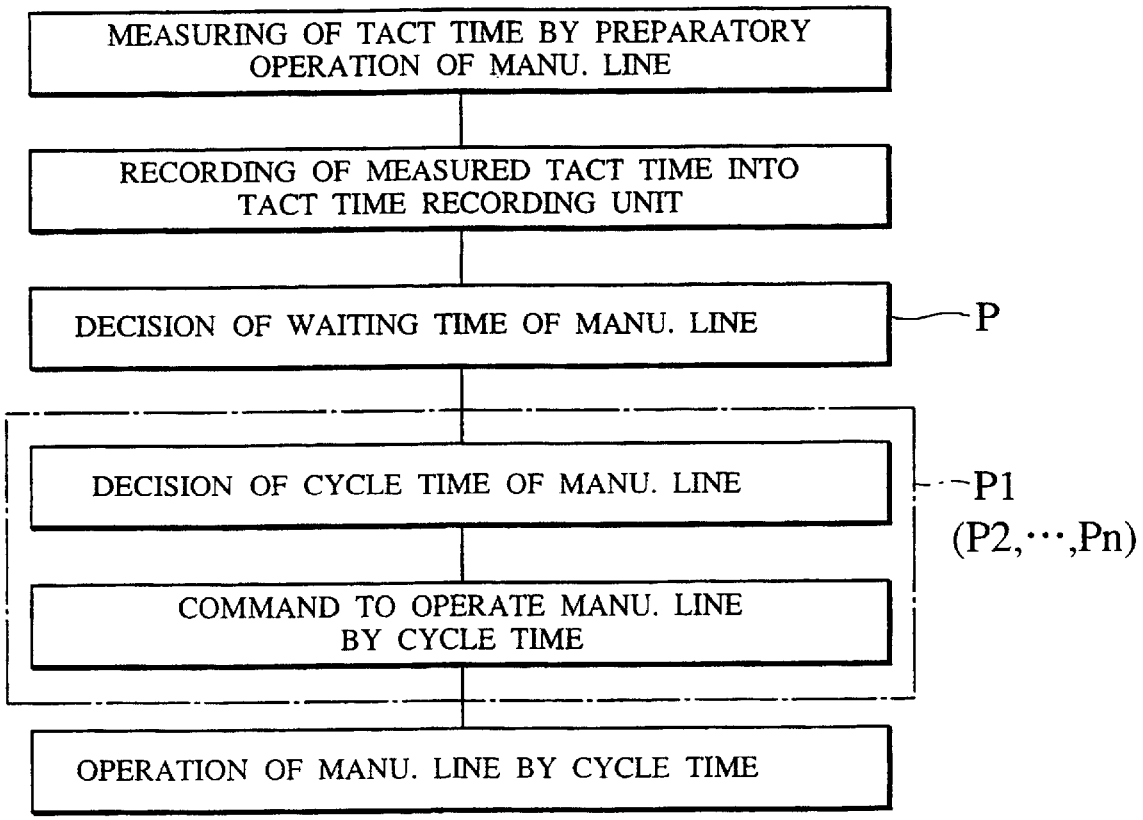
FIG. 5 is a flow chart of processes executed by the control system of FIG. 3.

In detail, the method of controlling the tact time is carried out in accordance with a flow chart shown in FIG. 5.

First of all, repeatedly, the tact time of the manufacturing line L1 (L2, . . . , Ln) is measured by preliminarily operating each manufacturing line L1 (L2, . . . , Ln) in advance of the practical operation.

For each line control device P1 (P2, . . . , Pn), the actually-measured tact time is inputted from the line input unit 6 and registered in the tact time recording unit 14.

The system CPU 11 reads the tact time recorded in the tact time recording unit 14 of the line control device P1 (P2, . . . , Pn) and determines the waiting time of each manufacturing line L1 (L2, . . . , Ln) by comparing the former tact time with the latter tact time. The waiting time is transmitted to the line CPU 4 of each line control device P1 (P2, . . . , Pn) through the reservation data transmitting unit 13.

The line CPU 4 calculates the inputted waiting time and the tact time read from the tact time recording unit 14 to determine the cycle time of the corresponding manufacturing line. Then, the cycle time is transmitted to the production command unit 7 since the operation start signal is inputted.

The production command unit 7 output signals so that the corresponding manufacturing line operates in accordance with the cycle time.

According to the tact time controlling method mentioned above, since the tact time is measured by operating the manufacturing line L1 (L2, . . . , Ln) actually and thereafter, the waiting time and the cycle time are obtained on the basis of the tact time, it is possible to obtain the cycle time with high accuracy. Therefore, the manufacturing lines L1, L2, . . . , Ln are controlled so as to reduce the intermediate stocks among the manufacturing lines due to the manufacturing loads to the utmost, by the respective cycle time with high accuracy.

Figure 6:
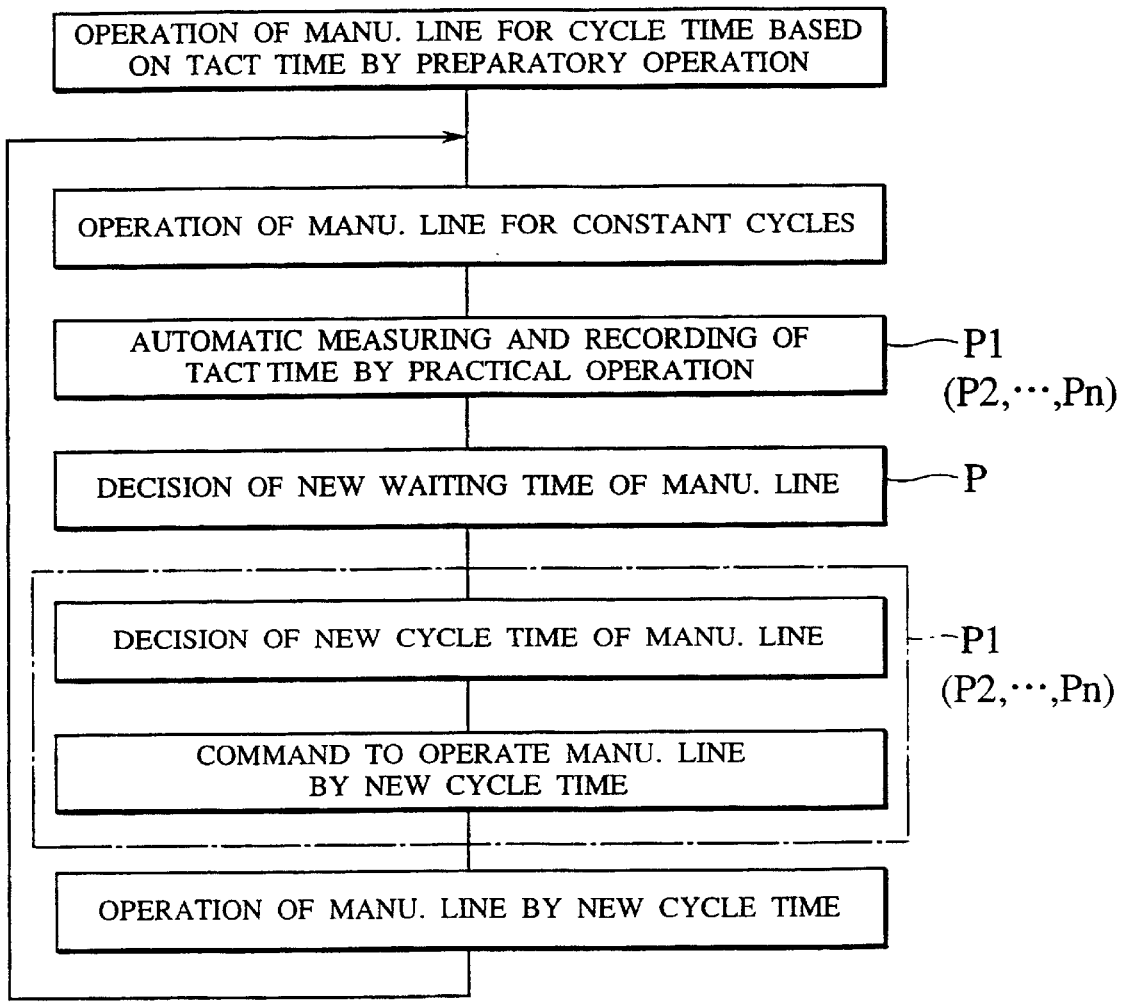
FIG. 6 is a flow chart of the other processes executed by the control system of FIG. 3.

As to the above tact time controlling method, it is preferable to carry out it while including the control revised after operating the manufacturing line actually. The revise control after the practical operation is carried out in accordance with a flow chart of FIG. 6.

First, the line control device P1 (P2, . . . , Pn) automatically measures the tact time of the practical operation after finishing the operation of the corresponding manufacturing line L1 (L2, . . . , Ln) at constant cycles and replaces the afore-registered tact time with the above tact time of the practical operation for registration.

The automatic measurement of tact time due to the practical operation is executed by the line CPU 4 driving in accordance with the line control program stored in the line control devices P1 (P2, . . . , Pn). Therefore, the measured tact time due to the practical operation is used for correcting the pre-registered tact time, so that the corrected one is recorded in the tact time recording unit 14.

Next, the system control device P calculates new tact time for each manufacturing line on the basis of the tact time of the practical registered in the line control device P1 (P2, . . . , Pn).

That is, the system CPU 11 reads the corrected tact time registered in the tact time recording unit 14 of the line control device P1 (P2, . . . , Pn) and calculates new waiting time for each manufacturing line, in accordance with the system control program stored in the system control device P. In this way, the waiting time determined in the previous cycle is corrected.

Next, it is executed to transmit the new waiting time to the line control device P1 (P2, . . . , Pn) of the manufacturing line.

Thus, the new waiting time is transmitted to the line CPU 4 of the line control device P1 (P2, . . . , Pn) through the reservation data transmitting unit 13.

Further, the line control device P1 (P2, . . . , Pn) calculates the new cycle time of the corresponding manufacturing line and controls the operation of the manufacturing line in accordance with the cycle time. The cycle time determined in the previous cycle is corrected by the calculation of the new cycle time.

Thus, the line CPU 4 calculates the new cycle time of the corresponding manufacturing line on the calculation of the new waiting time inputted and the corrected tact time from the tact time recording unit 14. This new cycle time is transmitted to the production command unit 7 by the operation start signal's input in the next cycle. The production command unit 7 output signals so that the corresponding manufacturing line operates in accordance with the new cycle time.

The review (checking) control after the actual operation is repeated every after the actual operations of the constant number of cycles.

According to the tact time controlling method including the review control, since the tact time, the waiting time and the cycle time are reviewed for their correction every after the actual operations of the constant number of cycles, it is possible to manage the respective cycle time of the manufacturing lines L1, L2, . . . , Ln with high accuracy. Consequently, it is possible to reduce the intermediate stocks among the manufacturing lines furthermore and manage the cycle time of the whole system with high accuracy, whereby the productivity can be improved furthermore.

Finally, it will be understood by those skilled in the art that the foregoing description is related to some preferred embodiments of the disclosed wire harness manufacturing apparatus and the tact time controlling method, and that various changes and modifications may be made to the present invention without departing from the spirit and scope thereof.

Industrial Applicability

There is provided with a wire harness manufacturing apparatus and a tact time controlling method thereof, both of which are-capable of reducing the occurrence of intermediate stocks to the utmost and also facilitating a measure against the change of design of the wire harness or the change in manufacturing line itself, whereby it is possible to establish the manufacturing line in a remarkable short time if such a change is raised.

What is claimed is:

1. A wire harness manufacturing apparatus comprising:

plural manufacturing lines for respectively manufacturing plural sub-wire harnesses as constituents of a wire harness to be produced, each of the manufacturing lines comprising plural constituent devices arranged in manufacturing order of each sub-wire harness;

plural line control devices provided for controlling operational processes of the manufacturing lines respectively, each of the line control devices being connected with the constituent devices of each of the manufacturing lines through a signal transmitting circuit; and at least one system control device adapted so as to construct a signal transmitting network together with the line control devices, for controlling manufacturing loads among the plural manufacturing lines, wherein each of the line control devices comprises:

a variable data recording unit for recording variable data in the constituent devices and a variable data altered later;

a line central processing unit for judging whether constitution of the constituent devices in the manufacturing line is appropriate by comparing production reserving data inputted from the system control device with the variable data, the line central processing unit further judging whether the manufacturing line modified on the basis of the former judgment is appropriate or not;

a line display unit for displaying both variable data recorded on the variable data recording unit and result of judgment obtained by the line central processing unit;

a line input unit for inputting an operation starting signal and the altered variable data obtained by modifying the manufacturing line in accordance with a result of judgment by the line central processing unit; and a production command unit for inputting the production reservation data generated from the line central processing unit as a result of the line input unit's inputting the operation start signal, the production command unit sequentially outputting the production command signal based on the production reservation data to each of the constituent devices, wherein the system control device comprises:

a data base for the wire harness to be produced;

a common data recording unit for recording common data in common with the plural manufacturing lines and the sequent common data added later;

a system input unit for inputting product data of the wire harness and the added common data;

a system central processing unit for making out an article numbers' list of the sub-harnesses constituting the wire harness by comparing the product data with the data recorded in the data base;

comparing the data of the sub-wire harnesses of respective article numbers with the above common data and the variable data in the respective data recording units in the line control devices in order to determine the manufacturing line in charge of each sub-wire harness with the article number; and making out the production reservation data for each manufacturing line determined, on the basis of the product data;

a system display unit for displaying the product data, the common data, the variable data, the article numbers' list, the determined manufacturing lines in charge and the production reservation data; and a reservation data transmitting unit for transmitting the production reservation data to the line central processing unit of the line control device of the manufacturing line being determined, and wherein, in each of the manufacturing lines, the line control device includes a tact time recording unit for recording tact time of the corresponding manufacturing line being inputted by the line input unit;

the line central processing unit includes one function to calculate waiting time being inputted through the system control device and the tact time thereby to determine cycle time of the corresponding manufacturing line and another function to transmit the cycle time to the production command unit upon inputting the operation starting signal; and the production command unit includes a function to output signals so that the corresponding manufacturing line works in accordance with the cycle time; and wherein the system central processing unit includes one function to comparatively calculate respective tact time registered in the tact time recording units of the plural line control devices thereby to determine respective waiting time of the plural manufacturing lines and another function to transmit the respective waiting time to the reservation data transmitting unit; and the reservation data transmitting unit includes a function to transmit each waiting time to the line central processing unit of the corresponding line control device.

* * * * *

UNITED STATES PATENT AND TRADEMARK OFFICE

CERTIFICATE OF CORRECTION

PATENT NO. : 6,658,312 B1
DATED : December 2, 2003
INVENTOR(S) : Katsumi Hagiyama It is certified that error appears in the above-identified patent and that said Letters Patent is hereby corrected as shown below:

Column 3,
Line 39, change “manufacturing likes” to -- manufacturing lines --.
Between lines 43 and 44, insert the following omitted paragraph -- In the line control device, it is judged whether the constitution of devices in the manufacturing line is proper for manufacturing the sub-wire harness of specified article number as an object to be produced, on the basis of the production reservation data. When it is judged that the constitution is proper, thereafter, it is maintained. If not proper, the existing constitutuion of the devices is rearranged and altered to produce the sub-wire harness of the objected article number. The rearrangement for the appropriate constitutuion can be carried out on the basis of the judgment result by the line control device with ease. Therefore, it is possible to provide the device constitution allowing the intermediate stocks among the devices to be reduced to the utmost --.

Column 5,
Line 45, change “the accompany drawing” to -- the accompanying drawing --.

Column 8,
Line 38, change “to be manufacture” to -- to be manufactured --.
Line 44, change “for every sorts of” to -- for all sorts of --.
Line 48, change “for every sorts of” to -- for all sorts of --.
Line 64, change “manufacture are” to -- manufactured are --.

Column 10,
Line 44, change “P1,…, Pn” to -- P2,…, Pn --.

Column 11,
Line 54, change “carry out it while” to -- carry it out while --.

Signed and Sealed this

Twenty-ninth Day of June, 2004

JON W. DUDAS
*Acting Director of the United States Patent and Trademark Office*